United States Patent [19]

Schabauer

[11] 3,982,465

[45] Sept. 28, 1976

[54] CARTRIDGE CASE DECAPPING TOOL

[76] Inventor: Fritz M. Schabauer, 1309 N. Windsor Ave., Bayshore, N.Y. 11706

[22] Filed: Nov. 13, 1974

[21] Appl. No.: 523,505

Related U.S. Application Data

[63] Continuation-in-part of Ser. No. 346,738, Feb. 4, 1973, abandoned.

[52] U.S. Cl. ..... 86/36; 86/23; 89/1 B

[51] Int. Cl.[2] ..... F42B 33/10

[58] Field of Search ..... 86/1, 36, 37, 38, 23, 86/24, 31, 32, 33; 72/DIG. 25; 89/1 B; 102/39, DIG. 5; 60/632–636; 29/427, 200 D

[56] References Cited

UNITED STATES PATENTS

| | | | |
|---|---|---|---|
| 2,213,435 | 9/1940 | Temple, Jr. | 89/1 B |
| 2,732,897 | 1/1956 | Musser | 72/DIG. 25 |
| 2,741,148 | 4/1956 | Thompson, Jr. | 86/23 |
| 2,926,607 | 3/1960 | Muller, Jr. et al. | 102/39 |
| 3,106,131 | 10/1963 | Barr et al. | 89/1 B |
| 3,745,875 | 7/1973 | Kennedy | 86/23 |

FOREIGN PATENTS OR APPLICATIONS

| | | | |
|---|---|---|---|
| 563,930 | 10/1932 | Germany | 86/36 |

*Primary Examiner*—Harold Tudor
*Attorney, Agent, or Firm*—Donald P. Gillette

[57] ABSTRACT

A tool for removing detonated Berdan primers from fired cartridge cases has a sleeve to support an undetonated primer at one end immediately adjacent the inside surface of the closed end of the cartridge against which the end of the sleeve fits snugly. A firing pin longitudinally movable within the sleeve and extending from the other end explodes the primer when tapped sharply, and the explosive force through the small flash holes in the closed end of the case ejects the spent primer from the case. The sleeve is cylindrical an is just slightly smaller than the open end of the case. It has a cylindrical pocket at the end that accepts either a Berdan, Boxer, or other type of primer and has a longitudinal bore that is smaller than the diameter of such primer and guides the end of the firing pin. At the other end of the sleeve is a handle of larger diameter than the sleeve and preferably provided with a reentrant recess.

10 Claims, 18 Drawing Figures

CARTRIDGE CASE DECAPPING TOOL

BACKGROUND OF THE INVENTION

1. Field of the Invention

This is a continuation-in-part of application Ser. No. 346,738, filed Feb. 4, 1973, now abandoned.

This invention relates to the field of cartridge reloading and particularly to a tool for holding an unused primer inside a used cartridge case and snugly against the closed end thereof to dislodge a spent primer from its recess on the outside surface of the closed end by exploding the primer inside the case so that the force therefrom will be directed through the flash holes in the closed end and against the spent primer.

2. The Prior Art

Many sportsmen and target shooters prefer to load their own cartridge cases. The cost is lower and the reloader has the choice of using different weights of bullets in varying amounts and types of powder. There are two principle types of cartridge cases in use today, the Boxer and the Berdan type. The Boxer type employs a rather large axial flash hole and, for this reason, it can be reloaded easily. A pin punch is inserted through the open end of the used cartridge and into the hole to push the spent primer out. The Boxer primer has a built-in anvil so that a sharp blow from a firing pin on the closed end of the primer will suddenly compress the explosive material in the primer and cause it to ignite. The Berdan type does not have its own anvil and is therefore simpler and inherently cheaper than the Boxer type. The Berdan primer relies on an anvil built into the case itself at the center of the primer cavity. Two or more flash holes of small diameter are spaced around the central anvil.

Because of the location and size of these holes, it is impractical to force the Berdan primer out of the cartridge case by mechanical means as is done with the Boxer primer. Water pressure has been attempted as a means of ejecting spent Berdan primers, but it requires a complex assembly to retain water that would otherwise be backwardly directed through the open end of the cartridge, and in any event, it requires means to contain the water that is forced through the flash holes in dislodging the spent primer. Alternatively, a lathe can be used to rout out the spent primer, but such a technique is also expensive and inconvenient.

In certain types of ammunition a Boxer type primer is crimped into place so that, even with the relatively large flash hole, a spent, crimped primer is difficult to remove.

The principal object of the present invention is to provide a compact tool with which Berdan primers and crimped-in Boxer primers can be removed from fired cartridge cases.

Another object of the invention is to provide improved cleaning of the flash holes in fired cartridge cases, since such holes would otherwise have to be cleaned by other methods for best performance when the cartridge cases were reloaded.

Another object of the invention is to increase the speed with which the spent primer, especially Berdan primers, can be ejected.

Still a further object of the invention is to provide a pin and sleeve combination that can easily be applied to commercially available reloading presses of the type normally used to reload cartridge cases.

SUMMARY OF THE INVENTION

The invention comprises a decapping tool for the removal of spent primers from cartridge cases. The tool comprises a cylindrical sleeve preferably only slightly smaller than the open end of the case therein. The sleeve has a short cylindrical cavity at one end for holding a primer. The depth of the cavity is preferably not substantially greater than the primer that fits into it, so that this primer will be held at or close to the very end of the sleeve. The end of the sleeve is shaped to fit as snugly as possible against the inner surface of the closed end of the case so that all explosive force from the primer will be constrained to the area that includes the flash holes. A firing pin extends through an axial bore in the sleeve, and one end of the pin is preferably sharpened. The other end of the firing pin preferably has an enlarged head that extends beyond the other end of the sleeve so that the latter end of the pin can be tapped or otherwise subjected to sufficient mechanical force to explode the primer. The explosive force therefrom drives out the spent primer in its receptacle on the outer surface of the closed end of the case. The cartridge is supported by a base having a cavity for receiving the lower end of the cartridge and a conduit through which the primer is ejected.

A handle may be added to the sleeve for convenient manual operation. The inserted primer in the cavity at the end of the sleeve may be a Boxer or Berdan primer of the same size as the spent primer being removed or may even be smaller. A reusable anvil may be attached to the end of the sleeve to be used when Berdan primers are used to dislodge spent primers.

Other features and additional details of the invention will be disclosed in the following description and accompanying drawings.

DESCRIPTION OF THE PREFERRED EMBODIMENT

Figure 1:
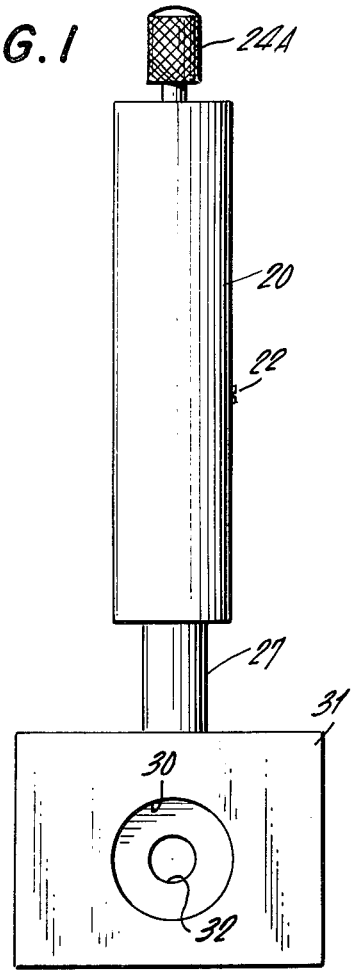
FIG. 1 is a side view of a decapping tool according to the invention.
Figure 2:
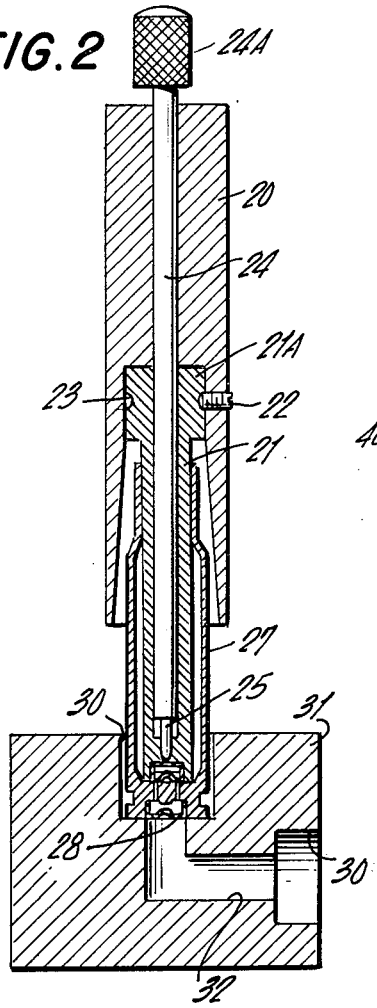
FIG. 2 is a cross-sectional view of the tool shown in FIG. 1 and is taken along a median line of that figure.
Figure 3:
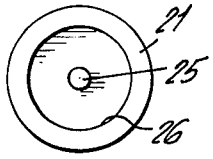
FIG. 3 is a bottom view, to an enlarged scale, of the sleeve before the primer has been put into place.
Figure 4:
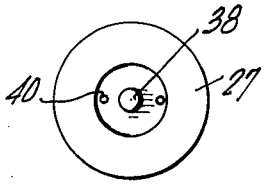
FIG. 4 is a bottom view of a Berdan cartridge case after the primer has been removed, showing the two flash holes and the central, integral anvil.

FIGS. 1 through 6 show a cartridge case decapping tool that comprises a handle 20 to be held by an operator during the decapping operation. A sleeve 21, which is shown in this embodiment as having an enlarged head 21A, is positioned within the handle as indicated in FIG. 2. The handle and sleeve may be joined by a set screw 22 that fits into an annular slot 23 cut in the head 21A, or they may be held together by screw threads or by magnetic attraction. A firing pin 24 with an enlarged head 24A is slidably positioned in an aligned axial bore in both the handle 20 and the sleeve 21. The end of the firing pin is formed with a sharpened point at the end of a section 25 of lesser diameter, within a correspondingly smaller bore in the sleeve 21.

Figure 15:
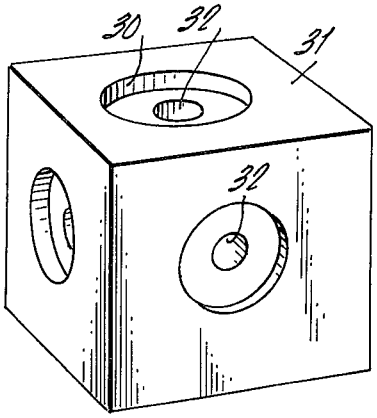
FIG. 15 is an isometric view of the base block used with the tool.

The end of the sleeve 21 remote from the handle 20 is formed with a cylindrical recess, or pocket or cavity, 26 (FIGS. 9, 10, and 16) for holding an unexploded primer. The tool is held with the cavity 26 facing upwardly to receive the primer. After the primer has been inserted, an unloaded cartridge case 27 having a spent primer 28 is placed over the sleeve to hold the primer in the cavity 26, and the assembly of the sleeve 21 with its handle 20 and the case 27 is inverted, and the closed end of the case 27 is placed in a cavity 30 in a base block 31. The block 31 also includes one or more conduits 32 for ejection of the spent primer 28 and for emission of explosive shock waves and combustion products. The block 31 may be formed with a number of cavities 30, as shown in FIG. 15 for use with different sized cartridges.

Figure 5:
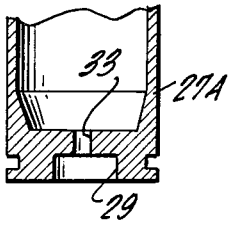
FIG. 5 is a partial cross-sectional view of a Boxer cartridge case without a primer.
Figure 6:
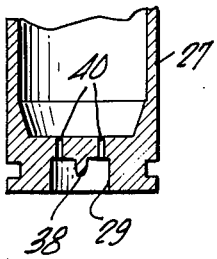
FIG. 6 is a partial cross-sectional view of a Berdan cartridge case without a primer.
Figure 7:
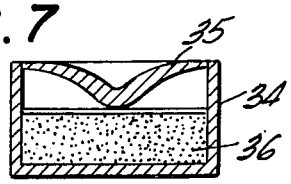
FIG. 7 is a cross-sectional view of a Boxer primer.

FIGS. 5 and 6 show the relative features of the Boxer cartridge case 27A and the Berdan cartridge case 27. The Boxer cartridge case 27A is formed with a central flash hole 33 and a cylindrical recess 29 for the primer cap. This type of cartridge requires a Boxer primer cap 34 with a built-in anvil 35 as illustrated in FIG. 7. An explosive charge 36 is placed in the cap and retained in position by a thin layer 37 of paper or fabric. There is normally no problem in removing a spent primer cap from a Boxer cartridge since the flash hole is large enough to permit the insertion of a pin punch large enough and strong enough to remove the spent cap with a light blow of a hammer. An exception is the type of cartridge case using a crimped-in Boxer primer, which requires more forceful ejection means.

Figure 8:
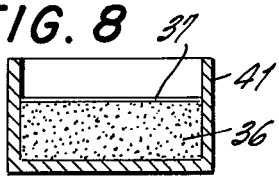
FIG. 8 is a cross-sectional view of a Berdan primer.

The Berdan type of cartridge case 27 shown in FIG. 6 has a built-in anvil 38 (see also FIG. 4) and two flash holes 40 leading from the primer recess 29 to the interior of the cartridge case. The primer cap 41 used with this type of cartridge is shown in FIG. 8 and includes only the explosive charge 36 retained by a layer 37 of paper, cloth, or the like. An anvil is not placed in the primer cap because an integral anvil is formed in the cartridge case. Heat from the detonated material 36 travels through to the powder in the cartridge case 27 to fire the cartridge. However, the size of the holes 40 and their location makes it impractical to use a mechanical punch to extract the detonated primer from the recess 29 to reload the case 27 after the cartridge has been fired.

Figure 9:
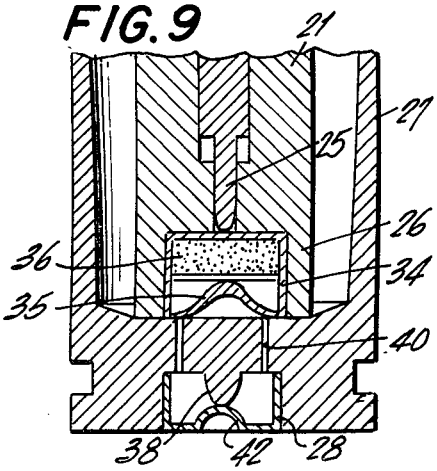
FIG. 9 is a partial cross-sectional view of a Berdan cartridge case with a spent primer and the lower end of the decapping tool holding a Boxer primer.
Figure 11:
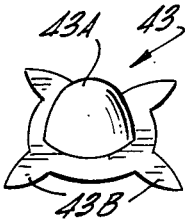
FIG. 11 is an isometric view, to an enlarged scale, of the reusable anvil of FIG. 10.

FIG. 9 shows the closed end of a Berdan cartridge 27 on a larger scale to clarify the details of construction. In this arrangement, a spent Berdan primer cap 28 is shown in the cartridge base with an indentation 42 left by the firing pin of the gun. A Boxer type primer cap 34 with its anvil 35 in place is positioned at the end of the sleeve 21. The end of the sleeve is squared-off, or cut perpendicularly to its axis, to be held snugly in contact with the inside surface of the base, or closed end, of the cartridge, and a sharp blow on the firing pin 24 drives the point 25 into the cap 34, exploding the charge 36 and driving the spent cap 28 out of the cartridge base.

Figure 10:
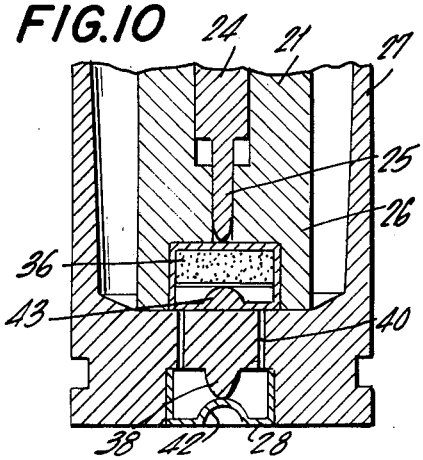
FIG. 10 is a view similar to FIG. 9 but showing a Boxer primer plus a reusable anvil.

FIG. 10 shows a similar arrangement but in this figure, a Berdan type of primer cap 41 is used as the means to eject the spent cap 28. Since the Berdan cap has no anvil, one must be provided. A small ball may be used or the anvil 43 is formed with a central knob 43A and extensions 43B that center the knob and provide a retaining means to keep the anvil in place when the sleeve 21 is placed in the cartridge. The anvil 43 is made of metal and is reusable. The operation is the same as described above for the Boxer primer.

Figure 12:
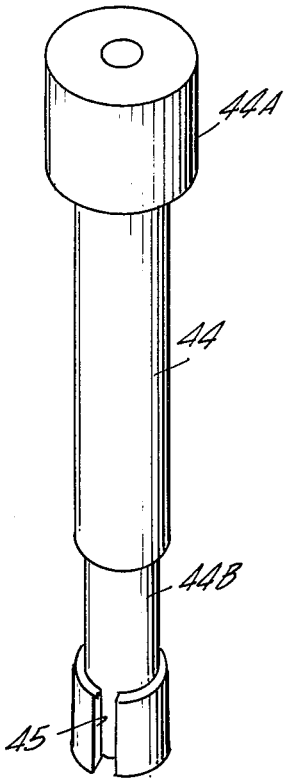
FIG. 12 is an isometric view of an alternate form of sleeve, formed to support an anvil carrier.
Figure 13:
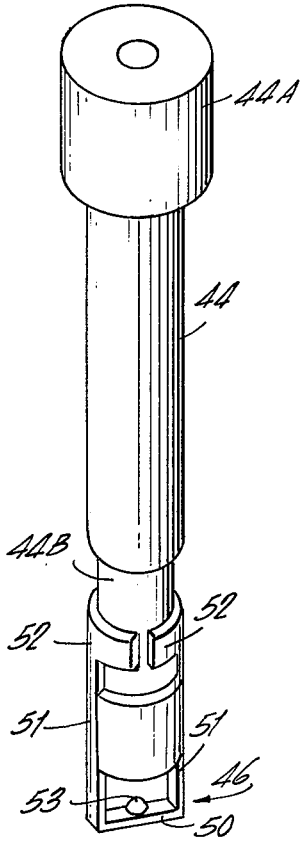
FIG. 13 is a view of the sleeve shown in FIG. 12 but with the anvil carrier on the sleeve and in a slightly extended position.
Figure 16:
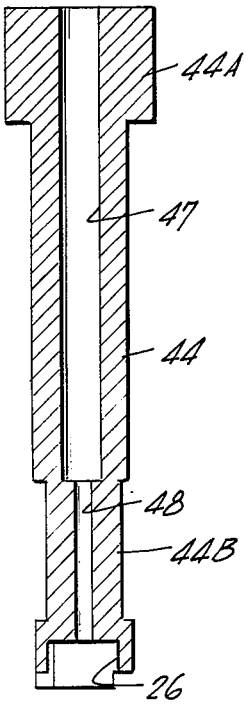
FIG. 16 is a cross sectional view of an alternate form of sleeve.
Figure 17:
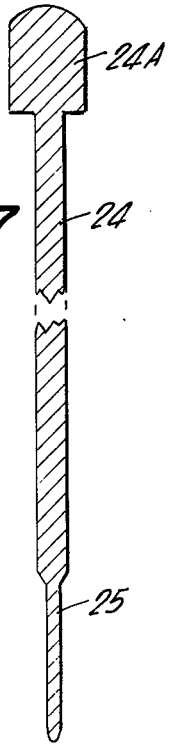
FIG. 17 is a cross sectional view of the firing pin.

A sleeve 44 shown in FIGS. 12, 13, and 16 is an alternate form, and may be used instead of the sleeve 21. It includes an enlarged head 44A which can be inserted into the handle 20 as indicated in FIG. 2. The lower portion of the sleeve is formed with a section 44B of reduced diameter, and the end portion has two vertical slots 45 to accommodate straps of an anvil holder 46 shown in FIGS. 13 and 14. The sleeve 44 has an axial bore 47 and a smaller bore 48, similar to the bores in the sleeve shown in FIG. 2, and a firing pin 24 fits into the bore 47. A pointed firing point on the end section 25 fits into the bore 48 to strike the primer cap positioned in the recess 26.

Figure 14:
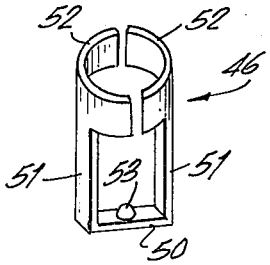
FIG. 14 is an isometric view of the anvil carrier before being attached to the sleeve.

The anvil holder 46 in FIGS. 13 and 14 includes a cross bar 50 supported by two vertical straps 51, terminated at their upper ends by C-shaped members 52 that grip the reduced section 44B of the sleeve 44. The straps 51 slide in the slots 45 in the sleeve, and the cross bar 50 supports an anvil 53. When this form of the invention is put into operation, a Berdan primer is placed in the recess 26, and the anvil holder 46 is pushed toward the handle 20 until the anvil 53 is lightly pressed against the bottom of the primer cap. Then the end of the sleeve 44 holding the primer is inserted into the cartridge 27. The firing pin 24 is inserted into the bore 47, and the bottom of the cartridge 27 is placed in one of the cavities 30 in base block 31 and the primer exploded to eject a spent primer from the cartridge case.

Figure 18:
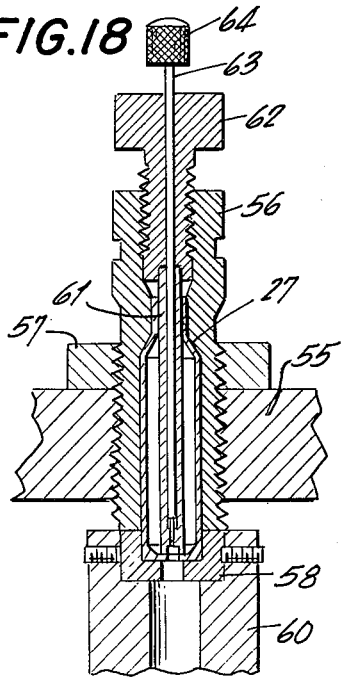
FIG. 18 is a cross sectional view of a standard reloading die with a modified sleeve and firing pin according to this invention.

FIG. 18 shows how a cartridge loader, available commercially, can be modified in accordance with the invention to make a decapping tool. The loading tool comprises a frame 55 secured to a base member (not shown) and a reloading die 56 threaded into the frame 55 and secured thereto by a lock unit 57. A standard shell holder 58 is secured to a vertically movable ram 60, also coupled to the base member, the ram and shell holder being axially aligned with the reloading die 56. In order to hold a hollow sleeve 61 against the bottom of the cartridge, a threaded plug 62, having an axial bore, is threaded into the upper portion of the die 56. The lower end of the plug 62 is counterbored to receive the upper end of the sleeve 61. The lower end of the sleeve 61 is formed with a bore of lesser diameter and a recess to receive a primer in the same manner as the sleeve 21 shown in FIG. 2. A firing pin 63 with an enlarged head 64 is positioned within the hollow plug 62 and the sleeve 61 to explode the charge in the manneer described above. Since the plug 62 can be screwed down to firmly seat the sleeve 61 against the inside surface of the cartridge 27, there is a minimum recoil when the primer is fired. In FIG. 18 the frame 55, the die 56, lock nut 57, shell holder 58, and ram 60, are all part of the cartridge loader which can be purchased from commercial sources.

What is claimed is:

1. A decapping tool for removal of a spent primer from a cartridge case by means of an explosive charge, the cartridge case comprising a tubular member with an open end and a closed end, the latter end having a primer recess extending into its outer surface and flash hole means through the closed end from the recess to the interior of the cartridge case, the tool comprising:

A. a cylindrical sleeve for insertion into the inside of a cartridge case, said sleeve comprising:
   1. a section having an external diameter slightly smaller than the open end of the cartridge case.
   2. a squared-off end adapted to fit snugly against the inter surface of the closed end of the cartridge case around the flash hole means.
   3. a cylindrical cavity extending axially into said squared-off end to receive an ejection primer and hold it immediately adjacent the inner surface of the closed end of the cartridge case, and
   4. a longitudinal bore from the cavity to the other end of the sleeve;

B. a handle attached to said sleeve remote from said squared-off end to permit said squared-off end to be held firmly against the inner surface of the closed end; and C. a firing pin slidably positioned in the bore, the length of the firing pin being greater than the length of the sleeve from the cavity to the other end thereof, one end of said pin extending beyond the other end of the sleeve for application of mechanical firing force to said one end of said firing pin to drive the other end of said firing pin against said ejection primer to explode the ejection primer.

2. The decapping tool of claim 1 in which said handle is an enlarged handle attached to said other end of said sleeve and substantially aligned therewith to facilitate gripping said tool and is generally cylindrical and aligned with said sleeve and has an end that overlaps said sleeve and forms, together with the proximal part of the sleeve, a reentrant recess around the

3. The decapping tool of claim 1 in which the longitudinal bore in the sleeve has a relatively large diameter portion for most of its length and a relatively small diameter portion between the large diameter portion and the cylindrical cavity.

4. The decapping tool of claim 3 in which the firing pin has a relatively large external diameter portion that fits slidably in the large diameter portion of the longitudinal bore and a smaller diameter portion that fits slidably in the small diameter portion of the longitudinal bore, the length of the small diameter portion of the firing pin being longer than the small diameter portion of the longitudinal bore to extend through the small diameter portion of the longitudinal bore to strike the primer when the mechanical firing force is applied to the other end of the pin.

5. The decapping tool of claim 2 in which the handle has a bore extending through it and aligned with the bore in the sleeve, and the firing pin extends through the length of the bore in the handle as well as the length of the bore in the sleeve.

6. The decapping tool of claim 5 in which the handle is removably attached to the sleeve to permit sleeves of different diameter to be attached to the handle according to the diameter of the open end of the cartridge case to be decapped.

7. The decapping tool of claim 1 comprising, in addition, an anvil member slidably attached to the outside of the sleeve at the squared-off end thereof and movable into contact with the primer in the cylindrical cavity.

8. The decapping tool of claim 7 in which the anvil member comprises strap means that engage the outer surface of the sleeve adjacent the squared-off end to hold the anvil member captive within a limited range of movement to permit primers to be inserted in the cylindrical cavity and removed therefrom after being exploded by pressure between the end of the firing pin and the anvil member.

9. The decapping tool of claim 8 in which the sleeve has a reduced diameter region near its squared-off end and the strap means comprise sections embracing the reduced diameter region of the sleeve.

10. The decapping tool of claim 1 in which the axial depth of said cylindrical cavity is at least approximately as great as the axial length of said unfired primer.

* * * * *